US010611534B2

(12) United States Patent
Melan-Moutet

(10) Patent No.: US 10,611,534 B2
(45) Date of Patent: Apr. 7, 2020

(54) CORK WIRING DEVICE FOR CLOSURE OF A STOPPER OF A BOTTLE OF CHAMPAGNE OR OTHER EFFERVESCENT DRINK

(71) Applicant: SOCIÉTÉ LORRAINE DE CAPSULES MÉTALLIQUES—MANUFACTURE DE BOUCHAGE, Contrexéville (FR)

(72) Inventor: Mathias Melan-Moutet, Reims (FR)

(73) Assignee: SOCIÉTÉ LORRAINE DE CAPSULES MÉTALLIQUES—MANUFACTURE DE BOUCHAGE, Contrexéville (FR)

( * ) Notice: Subject to any disclaimer, the term of this patent is extended or adjusted under 35 U.S.C. 154(b) by 0 days.

(21) Appl. No.: 15/904,184

(22) Filed: Feb. 23, 2018

(65) Prior Publication Data

US 2018/0237192 A1 Aug. 23, 2018

(30) Foreign Application Priority Data

Feb. 23, 2017 (FR) ..... 17 51442

(51) Int. Cl.
*B65D 55/06* (2006.01)

(52) U.S. Cl.
CPC ..... *B65D 55/063* (2013.01)

(58) Field of Classification Search
CPC ..... B65D 55/063; B65D 41/28; B65D 41/62
See application file for complete search history.

(56) References Cited

U.S. PATENT DOCUMENTS 292,367 A * 1/1884 Sachs ..... 215/291
445,803 A 2/1891 Curtis
(Continued)

FOREIGN PATENT DOCUMENTS

DE 72038 C 11/1893
DE 254653 C 12/1912
FR 421414 A 2/1911
(Continued)

OTHER PUBLICATIONS

French Search Report dated Oct. 11, 2017, issued in corresponding French Application No. FR 1751442, filed Feb. 23, 2017, 2 pages.

*Primary Examiner* — Anthony D Stashick
*Assistant Examiner* — L Kmet
(74) *Attorney, Agent, or Firm* — Christensen O'Connor Johnson Kindness PLLC

(57) ABSTRACT

Generally described, aspects of the disclosed subject matter are directed to a cork wiring device for closure of a stopper of a bottle of champagne or other effervescent drink. The cork wiring device generally includes an assembly made of metal wire and provided with two parts, namely on the one hand a cage having three legs, and on the other hand a band joined to a free end of each of said legs. The cork wiring device may also include a plate associated with the cage to constitute an interface, the three legs meeting at their end opposite to their free end, forming a loop, and the plate may include three exclusively lateral grooves, each of said lateral grooves being associated with one of said legs and intended to receive a portion of the associated leg located between the free end and the loop.

15 Claims, 4 Drawing Sheets

(56) References Cited

U.S. PATENT DOCUMENTS

| | | | | | |
|---|---|---|---|---|---|
| 3,339,775 | A * | 9/1967 | Valentin | ..... | B21F 45/00<br>215/291 |
| 9,187,216 | B2 * | 11/2015 | Jolly | ..... | B65D 55/063 |

FOREIGN PATENT DOCUMENTS

| | | | | | |
|---|---|---|---|---|---|
| FR | 2 836 456 | A1 | 8/2003 | | |
| FR | 2836456 | A1 * | 8/2003 | ..... | B65D 55/063 |
| FR | 2 918 042 | A1 | 1/2009 | | |
| FR | 2918042 | A1 * | 1/2009 | ..... | B65D 55/063 |

* cited by examiner

CORK WIRING DEVICE FOR CLOSURE OF A STOPPER OF A BOTTLE OF CHAMPAGNE OR OTHER EFFERVESCENT DRINK

BACKGROUND

Generally, a cork wiring device comprises an assembly made of metal wire and provided with two parts, namely on the one hand a cage comprising a ring intended to cover the top of the stopper (made of cork) and from which four legs extend radially, intended to be pressed down on the stopper and the neck of the bottle, and on the other hand a band that connects the free ends of said legs and that is flanged under a ring of said neck. The cork wiring device additionally comprises a metal plate that constitutes the interface with the stopper, being inserted between the latter and the ring, and that has the function from a technical standpoint of distributing the forces from the pressure and of preventing the metal wire becoming embedded in the cork, and from an aesthetic standpoint of producing a domed shape.

An exemplary cork wiring device of this kind, with a cage comprising four legs, is described in document FR-2 836 456.

However, a cork wiring device of this type has the drawback of requiring a considerable length of metal wire for making it.

To overcome this drawback at least, document FR-2 918 042 describes a cork wiring device comprising three legs that meet at the top of the cage, in a Y shape.

However, this last-mentioned cork wiring device also has drawbacks. Firstly, the forces exerted are not distributed uniformly, and this tends to generate a lateral force on the plate, which may move sideways and therefore has a problem of stability, notably with a risk of deformation of the plate.

The present disclosure is directed to overcoming these and other drawbacks.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

According to the disclosure, said cork wiring device is remarkable in that the three legs come together, at their end opposite to their free end, forming a loop, and in that the plate comprises three exclusively lateral grooves, each of said lateral grooves being associated with one of said legs and intended to receive a portion of the associated leg, located between the free end and the loop.

Thus, a cork wiring device is obtained, which, while using a shorter length of wire, because it only comprises three legs, makes it possible to overcome the aforementioned drawbacks of a cork wire with three legs in a Y shape. In fact, as a result of said loop, very stable positioning of the cage, and therefore of the cork wiring device, is obtained. Furthermore, this stability is reinforced by the three grooves provided exclusively in a side wall that receives portions of legs.

Furthermore, notably owing to the absence of grooves in the upper part of the plate, associated with balanced distribution of the forces generated by the circular loop, there is reduced risk of deformation of the plate, notably on its upper face.

In one embodiment, the plate comprises an annular recess for receiving said loop, which makes it possible to reinforce the positional stability. Preferably, said annular recess is delimited radially inwardly, on an outer face of the plate, by a peripheral flange and a central dome, the central dome formed outwardly convex from the plate and radially inwardly from the peripheral flange. This peripheral flange helps to center and hold the loop of the cork wiring device.

Moreover, advantageously, said legs are substantially rectilinear and are oriented radially towards the center of the loop, between the band and the loop.

In a first embodiment, said legs are distributed around the periphery of the loop, and between them form, respectively, two 135° angles and one 90° angle, the 90° angle being located angularly, relative to the circumference, at the level of an uncorking ring formed in the band. This preferred embodiment notably simplifies the production of the cork wiring device.

Furthermore, in a second embodiment, said legs, which are substantially rectilinear, are uniformly distributed around the periphery of the loop.

In the context of the present disclosure, the plate associated with the cage to form an interface with the stopper may be made of metal or of plastic.

DESCRIPTION OF THE DRAWINGS

The foregoing aspects and many of the attendant advantages of the present disclosure will become more readily appreciated as the same become better understood by reference to the following detailed description, when taken in conjunction with the accompanying drawings, wherein.

DETAILED DESCRIPTION

The detailed description set forth below in connection with the appended drawings, where like numerals reference like elements, are intended as a description of various embodiments of the present disclosure and are not intended to represent the only embodiments. Each embodiment described in this disclosure is provided merely as an example or illustration and should not be construed as precluding other embodiments. The illustrative examples provided herein are not intended to be exhaustive or to limit the disclosure to the precise forms disclosed.

In the following description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure.

Further, it will be appreciated that embodiments of the present disclosure may employ any combination of features described herein.

The present application may include references to directions, such as "forward," "rearward," "front," "rear," "upward," "downward," "top," "bottom," "right hand," "left hand," "lateral," "medial," "in," "out," "extended," etc. These references, and other similar references in the present application, are only to assist in helping describe and to understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value.

The present disclosure relates to a cork wiring device intended for the closure of a stopper of a bottle of champagne or other effervescent drink.

The cork wiring device is intended to hold the stopper on the bottle of champagne (or other effervescent drink), in order to guarantee its hermeticity despite the force exerted by the pressure of the gas.

Figure 1A:
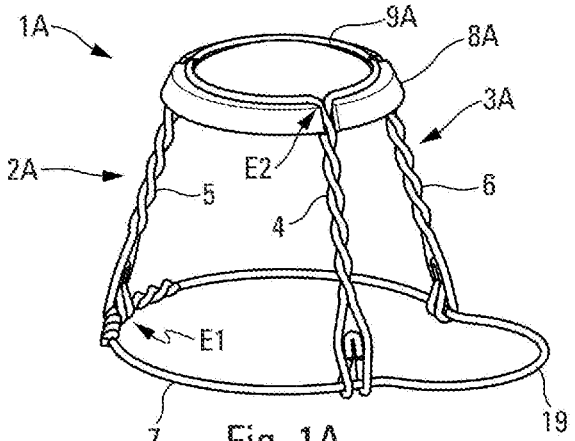
FIGS. 1A, 1B and 1C are, respectively, views in perspective, in bottom view, and in top view of a cork wiring device according to a first embodiment of the present disclosure.
Figure 1B:
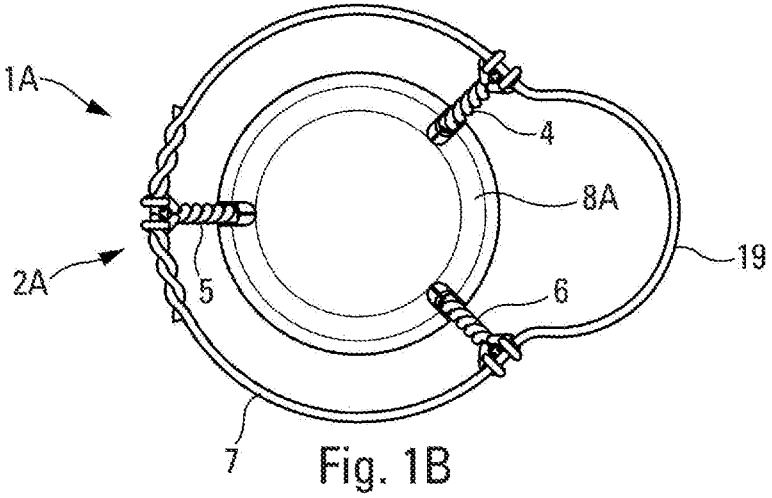
Figure 1C:
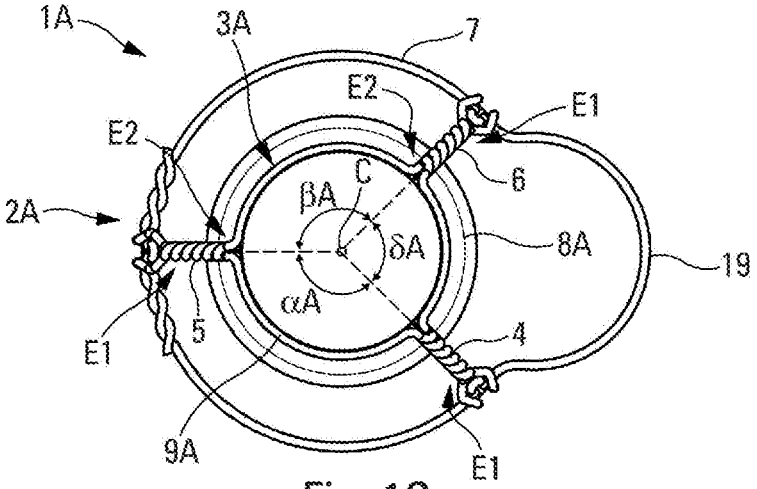
Figure 3A:
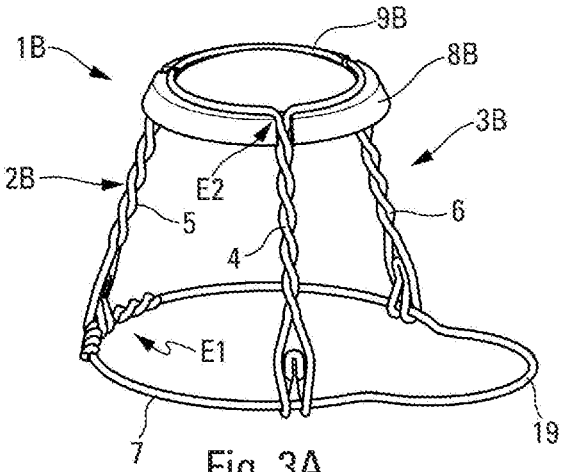
FIGS. 3A, 3B and 3C are, respectively, views in perspective, in bottom view, and in top view of a cork wiring device according to a second embodiment of the present disclosure.
Figure 3B:
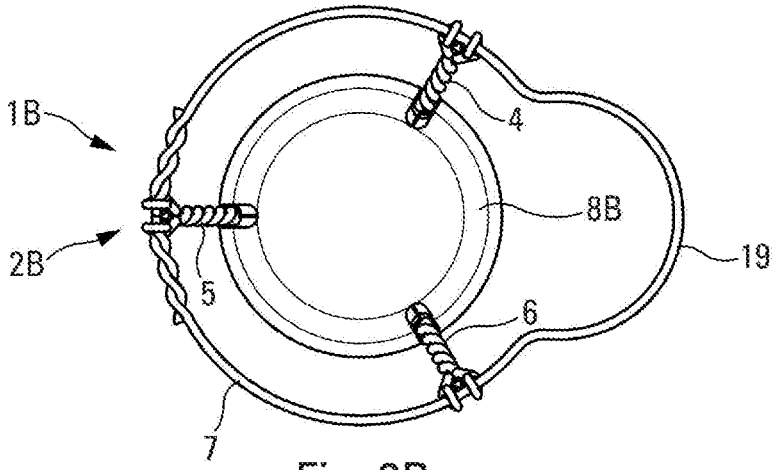
Figure 3C:
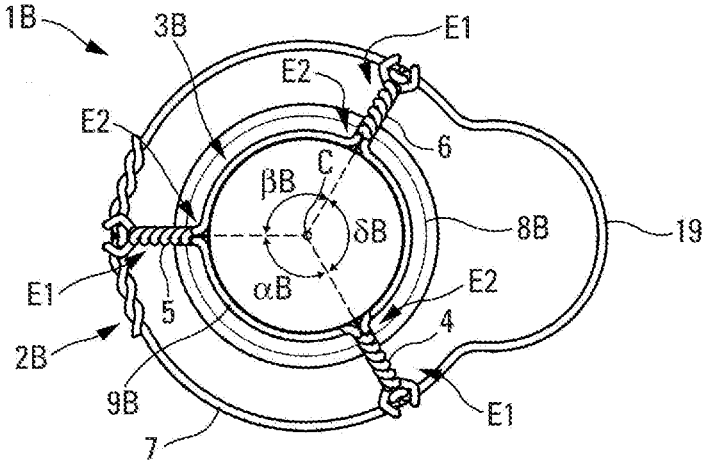

The cork wiring device shown according to a first embodiment 1A in FIGS. 1A to 1C, and according to a second embodiment 1B in FIGS. 3A to 3C, is intended for the closure of a stopper (not shown) of a bottle containing champagne or other effervescent drink.

In the following description, references comprising the letter A correspond to said first embodiment and those comprising the letter B correspond to said second embodiment.

In the illustrated embodiments, said cork wiring device 1A, 1B comprises an assembly 2A, 2B made of metal wire. This assembly 2A, 2B is provided with two parts, namely on the one hand a cage 3A, 3B comprising three legs 4, 5, 6, and on the other hand a band 7 joined to a free (or lower) end E1 of each of said legs 4, 5, 6.

According to the disclosure, the cork wiring device 1A, 1B is such that the three legs 4, 5, 6 meet at an end E2, opposite their free end E1, forming a loop 9A, 9B, as shown notably in FIGS. 1C and 3C. This loop 9A, 9B is of circular general shape.

Said cork wiring device 1 also comprises a plate 8A, 8B associated with the cage 3A, 3B to constitute an interface with the stopper. This plate 8A, 8B has the function, from a technical standpoint, of distributing the forces from the pressure and of preventing the metal wire becoming embedded in the cork of the stopper, and from an aesthetic standpoint of producing a domed shape.

Figure 2A:
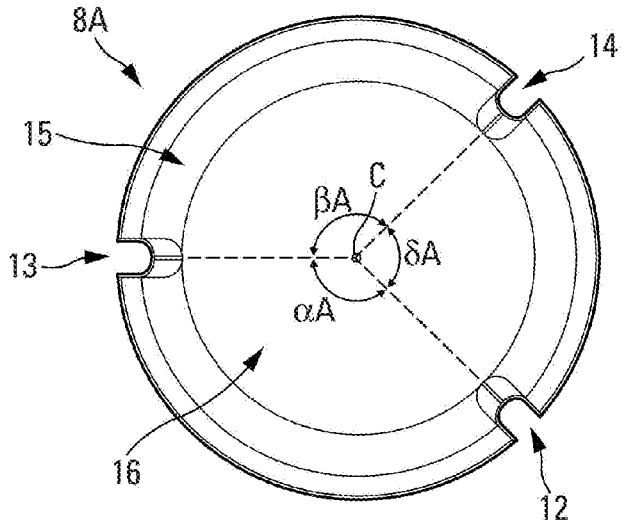
FIGS. 2A, 2B and 2C are, respectively, a top plan view, a side view, and a perspective top view of a plate of the cork wiring device according to the first embodiment.
Figure 2B:
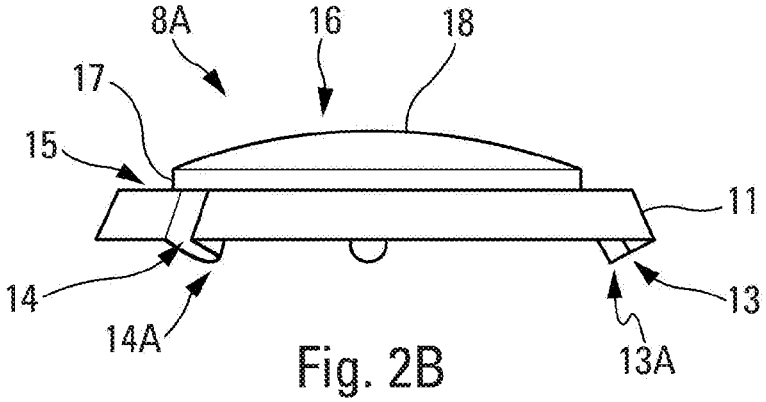
Figure 2C:
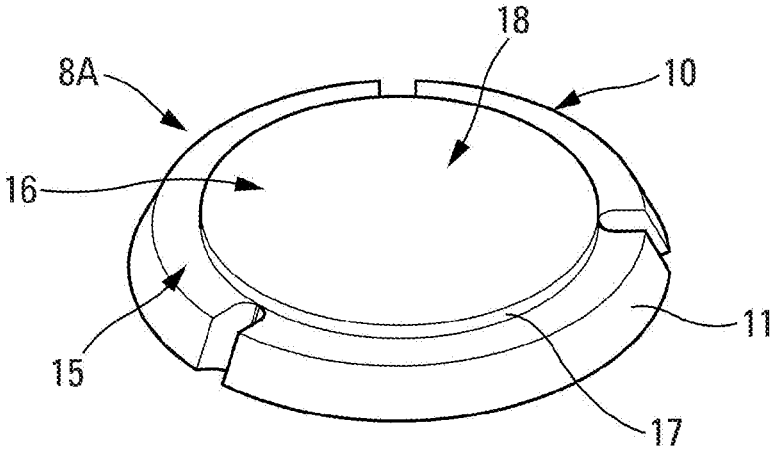
Figure 4A:
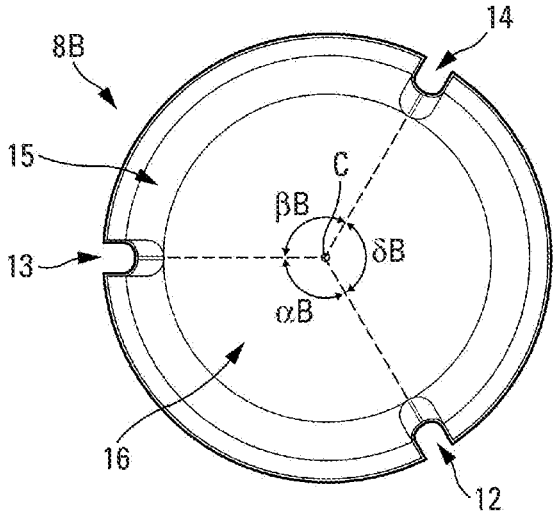
FIGS. 4A, 4B and 4C are, respectively, a top plan view, a side view, and a perspective top view of a plate of the cork wiring device according to the second embodiment.
Figure 4B:
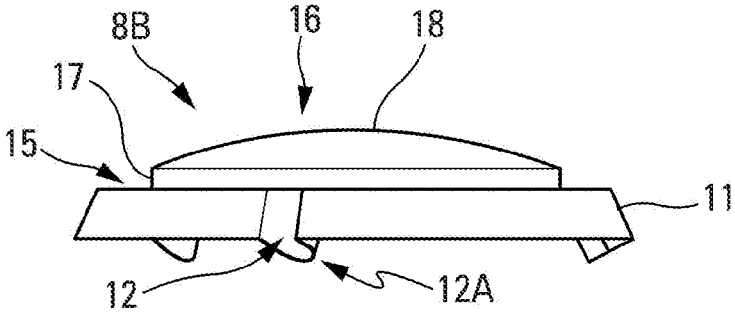
Figure 4C:
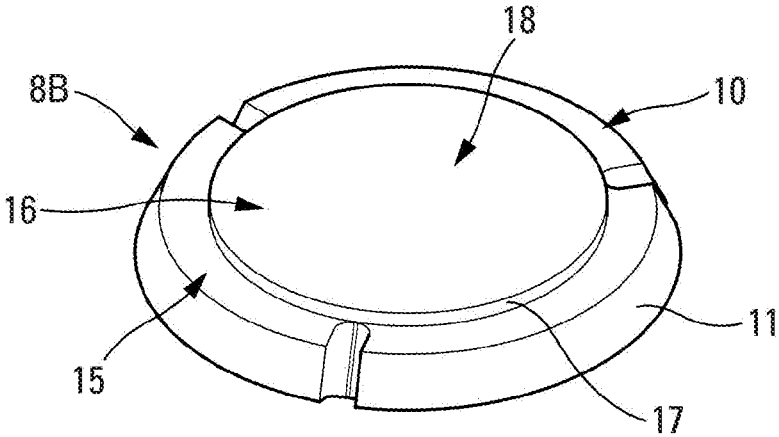

The plate 8A relating to the first embodiment 1A is shown more specifically in FIGS. 2A, 2B and 2C, and the plate 8B relating to the second embodiment 1B is shown more specifically in FIGS. 4A, 4B and 4C.

The plate 8A, 8B has a circular upper face 10 provided on its (outer) periphery with an annular lateral edge 11, transverse to the upper face 10 and slightly inclined outwards at the level of its free (bottom) edge.

Moreover, according to the disclosure, the plate 8A, 8B comprises three lateral grooves 12, 13 and 14 made exclusively in the lateral edge 11, as can be seen for example in FIGS. 2A and 4A. The lateral grooves 12, 13 and 14 are associated with said legs 4, 5 and 6 respectively. These lateral grooves 12, 13 and 14 are rectilinear, are made vertically along the wall 11 and in section partly have a shape of a circular arc. The grooves 12, 13 and 14 extend towards the bottom (towards the lower part) of the plate 8A, 8B, in the form of lugs 12A, 13A and 14A, as can be seen in FIGS. 2B and 4B. These grooves 12, 13 and 14 are intended to receive a portion of each associated leg 4, 5, 6, located between the free end E1 and the loop 9A.

Thus, a cork wiring device 1A, 1B is obtained, which, while using a shorter length of wire since it only comprises three legs 4, 5, 6, makes it possible to overcome the drawbacks of a cork wire with three legs in a Y shape. In fact, owing to said loop 9A, 9B, very stable positioning of the cage 3A, 3B and therefore of the cork wiring device 1A, 1B is obtained. This stability is, moreover, reinforced by the three grooves 12, 13 and 14 receiving portions of the legs 4, 5 and 6.

Moreover, notably owing to the absence of grooves in the upper part of the plate 8A, 8B, associated with balanced distribution of the forces generated by the circular loop 9A, 9B, there is reduced risk of deformation of the plate 8A, 8B notably on its upper face.

Furthermore, the aesthetic appearance is reinforced by absence of the grooves in the upper part of the plate 8A, 8B.

In the embodiments shown, the plate 8A, 8B comprises an annular recess 15 in the form of a flange, as shown for example in FIGS. 2C and 4C, which is intended to receive said loop 9A, 9B, which makes it possible to reinforce the positional stability of the assembly 2A, 2B.

Preferably, this annular recess 15 is delimited radially inwards, on a so-called outer face 16 of the plate 8A, 8B, by a peripheral flange 17. On this peripheral flange 17, a central dome 18 is formed, which is convex outwards and is formed in said plate 8A, 8B, as shown in FIGS. 2C and 4C.

The peripheral flange 17 forming a shoulder promotes centering of the loop 9A, 9B and helps to hold the loop 9A, 9B from inside.

Moreover, the three legs 4, 5 and 6 are substantially rectilinear and are oriented radially towards the center C of the loop 9A, 9B, in plan view, between the band 7 and the loop 9A, 9B.

In the first preferred embodiment 1A, as shown notably in FIG. 1C, the three legs 4, 5, 6 are distributed around the periphery of the loop 9A, between them forming, in plan view, respectively, two angles $\alpha A$ and $\beta A$ of 135° (between legs 4 and 5 and between legs 5 and 6) and an angle $\delta A$ of 90° between legs 4 and 6.

The 90° angle $\delta A$ is located angularly, relative to the circumference, at the level of an uncorking ring 19 formed in the band 7. This preferred embodiment notably simplifies the production of the cork wiring device 1A.

The grooves 12, 13 and 14 of the associated plate 8A are distributed similarly in plan, as shown in FIG. 2A.

Furthermore, in the second embodiment, as shown notably in FIG. 3A, the three legs 4, 5 and 6, which are substantially rectilinear, are uniformly distributed (in plan view) around the periphery of the loop 9B, i.e. with an angle $\alpha B$, $\beta B$, $\delta B$ of 120° between each pair of legs 4, 5 and 6.

The grooves 12, 13 and 14 of the associated plate 8B are distributed similarly in plan, as shown in FIG. 4A.

This second embodiment provides, with this uniform distribution, a balancing of the forces, leading to great stability and a low risk of deformation of the plate 8B.

Embodiment 1B differs from embodiment 1A by these different values of the angles. All the other elements have the same characteristics as those relating to the first embodiment.

The band 7 comprises a surplus of wire to allow clamping around the neck by twisting and creation of the uncorking ring 19.

In the context of the present disclosure, the plate 8A, 8B, associated with the cage 3A, 3B to form an interface with the stopper, may be made either of metal, or of plastic.

In a particular embodiment, the cage 3A, 3B is produced by shaping a single metal wire, doubled and twisted to form the legs, whereas the ends of the legs are then folded inwards on the neck side to form a loop for passage of the wire of the band 7. The cage 3A, 3B may also be produced according to a similar design, for example starting from two or four twisted wires.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A cork wiring device for the closure of a stopper of a bottle of effervescent drink, comprising:

an assembly, comprising, a cage made of metal wire and comprising only three legs, each leg having a distal end; and a band made of a single metal wire, the ends of the single metal wire being joined together by a twist, wherein the distal end of each of said legs is folded inwardly to form a leg loop for the passage of the band, the distal end of one of the legs being folded to encapsulate a portion of the twist of the band; and a plate associated with said cage to constitute an interface, the plate having three lateral grooves, wherein the legs are coupled to each other at a proximal end opposite the distal end to form a loop, and wherein each of the lateral grooves is associated with one of the legs for receiving a portion of the associated leg located between the distal end and the loop.

2. The cork wiring device of claim 1, wherein the plate comprises an annular recess for receiving the loop.

3. The cork wiring device of claim 2, wherein the annular recess is delimited radially inwardly, on an outer face of the plate, by a peripheral flange and a central dome, the central dome formed outwardly convex from the plate and radially inwardly from the peripheral flange.

4. The cork wiring device of claim 1, wherein, in plan view, said legs are substantially rectilinear and are oriented radially towards the center of the loop, between the band and the loop.

5. The cork wiring device of claim 4, wherein, in plan view, said legs are distributed around the periphery of the loop, between the legs forming, respectively, two angles of 135° and one angle of 90°, the angle of 90° being located angularly, relative to the circumference, at the level of an uncorking ring formed in the band.

6. The cork wiring device of claim 4, wherein, in plan view, said legs are substantially rectilinear and are uniformly distributed around the periphery of the loop.

7. The cork wiring device of claim 1, wherein the lateral grooves are formed exclusively in an annular side wall of the plate.

8. The cork wiring device of claim 1, wherein the plate is made of metal.

9. The cork wiring device of claim 1, wherein the plate is made of plastic.

10. The cork wiring device of claim 1, wherein the effervescent drink is champagne.

11. The cork wiring device of claim 1, wherein each leg is formed by twisting two sections of a single wire, wherein the distal end of each leg is inserted between the two sections that form each leg.

12. The cork wiring device of claim 1, wherein the distal end of said one of the legs being folded around a midspan of the twist of the band.

13. The cork wiring device of claim 1, wherein the leg loop of said one of the legs interfaces with a midspan of the twist of the band.

14. The cork wiring device of claim 1, wherein the leg loop of said one of the legs limits movement of the band.

15. A cork wiring device for the closure of a stopper of a bottle of effervescent drink, comprising:

a cage made of metal wire and comprising only three legs, each leg having a distal end, wherein the distal end of each of the legs is folded inwardly to form a leg loop;

a band made of a single metal wire that passes through the leg loop of each leg, the ends of the single metal wire being joined together by a twist, wherein the twist is positioned to extend through the leg loop of one of the legs; and a plate associated with said cage to constitute an interface with the stopper, the plate having three lateral grooves each configured to receive a section of a respective one of the legs.

* * * * *